United States Patent [19]

Norminton

[11] 4,365,574

[45] Dec. 28, 1982

[54] ONE-PIECE SNAP-ON FOIL-SHAPED LOW-DRAG FAIRING FOR LONG UNDERWATER CABLES

[75] Inventor: Robert S. Norminton, Niagara Falls, Canada

[73] Assignee: Fleet Industries, Ontario, Canada

[21] Appl. No.: 270,881

[22] Filed: Jun. 5, 1981

[30] Foreign Application Priority Data

Jun. 23, 1980 [CA] Canada ..... 354637

[51] Int. Cl.[3] ..... F15D 1/10

[52] U.S. Cl. ..... 114/243; 405/211

[58] Field of Search ..... 114/243, 244; 405/211, 405/216

[56] References Cited

U.S. PATENT DOCUMENTS

| | | | |
|---|---|---|---|
| 3,352,118 | 11/1967 | Burkhardt | 114/243 |
| 3,712,261 | 1/1973 | McLelland | 114/243 |
| 4,171,674 | 10/1979 | Hale | 114/243 |

FOREIGN PATENT DOCUMENTS

| | | | |
|---|---|---|---|
| 869811 | 5/1971 | Canada . | |
| 872007 | 6/1971 | Canada . | |
| 877061 | 8/1971 | Canada . | |
| 887428 | 12/1971 | Canada . | |
| 896987 | 4/1972 | Canada . | |
| 919998 | 1/1973 | Canada . | |
| 966015 | 4/1975 | Canada . | |
| 1018834 | 10/1977 | Canada . | |
| 1045471 | 1/1979 | Canada . | |
| 790001 | 1/1958 | United Kingdom | 114/243 |

*Primary Examiner*—Trygve M. Blix
*Assistant Examiner*—D. W. Keen
*Attorney, Agent, or Firm*—Birch, Stewart, Kolasch & Birch

[57] ABSTRACT

A one-piece fairing is provided which is a finite length monolithic one-piece, snap-on, foil-shaped, low drag fairing element of streamlined hydrodynamic shape, having an outer wall formed of high strength material, the fairing element being symmetrical about its central longitudinal axis, and adapted to be associated with a plurality of similar such fairing elements in end-to-end abutting relation on a cable. The fairing element comprises: a hollow rounded nose portion within which the cable is adapted to be disposed; a spring tail portion provided by a slit in the tail thereof along the central longitudinal axis; a hollow expandible channel symmetrical about the central longitudinal axis interconnecting the spring tail portion and the hollow nose portion, and through which the cable is adapted to be urged from its entry at the tail portion to its lodging at the hollow rounded nose portion; and an inner wall section of the high strength material spaced from the outer wall of the substantially hollow fairing element by a plurality of ribs of the high strength material. This structure thereby defines the hollow expandible channel and also a double wall section along the flanks of the fairing element between the nose portion and the tail portion.

9 Claims, 4 Drawing Figures

ONE-PIECE SNAP-ON FOIL-SHAPED LOW-DRUG FAIRING FOR LONG UNDERWATER CABLES

BACKGROUND OF THE INVENTION (i) Field of the Invention

This invention relates to one-piece snap-on, foil-shaped, low drag fairing element for use on long underwater cables.

(ii) Description of the Prior Art

When towing a submerged object, it is usually desirable that induced cable vibrations and noise be suppressed and that cable drag be minimized to achieve maximum depth for a given length of such underwater cable. These objects have been achieved in the past by enclosing the cable with fairings of more or less streamlined shape, or, less effectively with trailing ribbons or hair-like material embedded in the cable.

Cable fairing generally consists of a body attached to the cable to modify the flow characteristics of the water around such cable. In the use of fairing elements in a towed sonar system where a cable is used to tow a submerged body behind a vessel, drag on the towing cable is reduced by fairing elements attached in stacked relation longitudinally along the cable in close abutting relation. It is necessary to wind the tow line, with the fairing attached thereon, onto a winch drum and to accomplish this the fairing must be divided into a number of individual elements. In sonar systems, problems can be encountered from winding the cable with the fairing elements thereon onto the winch drum due to the fact that the fairing elements are rigid which results in a sharp transition in the cable intermediate each adjacent pair of fairing elements. A cable in a sonar system includes a plurality of electrical conductors and sharp bends ultimately can result in breaking one or more conductors. When this happens, the entire cable may have to be replaced.

One such prior art fairing is provided by U.S. Pat. No. 2,397,957 issued Apr. 9, 1946 to H. B. Freeman. That patent alleged to provide a fairing for a cable comprising a plurality of cable-wise normally aligned tail portions, and flexible means covering the tail portions and normally securing them in spaced relation each to the others and forming a head portion for embracing the cable with an easy fit. This was said to permit the fairing, and to a limited extent the separate tail portions, to swivel with respect to the cable.

Another such fairing is provided in U.S. Pat. No. 2,401,783 issued June 11, 1946 to K. H. Wilcoxon. That patent alleged to provide a cable fairing comprising a series of articulated fairing units and spring latch means. This was said to allow for easy releasably securing of the individual units in fairing relation to a cable.

Yet another detachable fairing assembly for use with carriers of sensitive instruments and the like which are towed through a fluid, e.g. water, at some distance from a towing vessel, was said to be provided in U.S. Pat. No. 3,209,718 issued Oct. 5, 1965 to R. L. Rather et al. That patent alleged to provide the combination with a marine towline assembly comprising a load-bearing line and at least one conductor external to such line, the addition of a plurality of removable fairings having two side walls embracing the external conductor at intervals along its longitudinal axis. The fairings were said to include quick-disconnect means for holding the conductor within the side walls of the fairings so as to permit longitudinal movement with respect to the load-bearing line.

A plurality of quick-disconnect, snap-on clamps were said to be secured along the load-bearing line, such clamps were said to have at least two arcuate interconnecting pieces for embracing the load-bearing line for transmitting the weight of the fairings and to have holding means to hold the fairings to the load-bearing line.

Still another fairing assembly with convenient snap-on characteristics for a tow-line assembly and which could attempt to overcome the problem that vibrations established on the line often interfered with reliable data results transmitted on the line by setting up false vibration patterns was said to be provided in U.S. Pat. No. 3,241,513 issued Mar. 22, 1966 to R. C. Rather et al. That patent alleged to provide a marine tow-line assembly for use in towing submerged objects. The assembly was said to comprise a channel member, ovoid in cross-section and having bilaterally symmetrical arcuate side walls with the opening through its apex. A line extended through the channel and was laterally removable therefrom. A fin member extended from one of the side walls and in a plane approximately bisecting the apex of the channel member and was said to provide the assembly with hydrodynamic stability. Means were included releasably engaging the line within the apex opening. This was said to retain the line releasably within the channel.

A further such fairing element was provided by Canadian Pat. No. 869,811 issued May 4, 1971 to F. W. W. Pfeiffer, assigned to Fleet Manufacturing Limited. That patent provided a fairing element adapted to be associated with a plurality of such elements in end-to-end abutting relation on a tow line. The fairing element included a rigid body having a pair of opposed longitudinal marginal edges. Means were provided for attaching the tow line or cable to the body to extend along a path intermediate the marginal edges and generally parallel thereto. A pair of opposed ends provided abutting surfaces on the adjacent elements arranged end-to-end and extending along a predetermined path. Means were provided including a portion on one end of the body cooperating with a portion on the opposite end of the body of an adjacent element permitting adjacent elements to remain in contact during angular changes of adjacent elements relative to one another and located such as to minimize any change in pitch length adjacent a path along which the cable is disposed.

Yet another patent proposing an improved fairing element is Canadian Pat. No. 872,007 issued June 1, 1971 to F. W. W. Pfeiffer, assigned to Fleet Manufacturing Limited. That patent provided the fairing elements which had adjacent faces fully in abutting relation when the cable is in a towing condition and a resilient compressible portion on such faces to deform upon the application of higher forces, for example, when the faired cable is wound onto a winch drum. The fairing elements were attached to the cable with the cable spaced inwardly from the marginal edges and thus when the faired cable was wound onto the winch drum, there was a change in curvature of the path followed by the cable. Resilient material was interposed between at least selected portions of adjacent fairing elements allowing compression, i.e., shortening of one edge of the pitch length of fairing element.

Still another such faired cable was provided by Canadian Pat. No. 877,061 issued Aug. 3, 1971 to H. H. Loshigian. That patent provided a faired cable having the outer cross-sectional contours of an airfoil so designed as to have its center of pressure approximately at the quarter chord position (as measured from the leading edge of the section). The forward part of the cross section was constituted by a rearwardly open channel-like or substantially U-shaped relatively less flexible strength member, this shape disposing its shear center considerably forward of its centroid and essentially in the immediate vicinity of the leading edge of the cable section. The aft part of the cross section is attached to the rearwardmost end of the cable part which includes the strength member, e.g., at the ends of the legs of the "U" or flanges of the channel, and has the form of a relatively more flexible tail of substantially triangular shape.

Still another such faired cable was provided in Canadian Pat. No. 887,428 issued Dec. 7, 1971 to H. H. Pearce et al. That patent provided fairings which were interconnected by link means extending between and permitting relative movement of adjacent fairings. Each fairing included a fin member of substantially symmetrical hydrofoil cross section provided with an arcuate opening in the leading edge thereof. The opening was constructed and shaped such that the fairing could be clipped to or unclipped from the tow line. The outer surface of each fairing in the region of the leading edge was provided with guide surfaces converging towards the leading edge.

A still further such faired cable was said to be provided in Canadian Pat. No. 896,987 issued Apr. 4, 1972 to N. E. Hale et al. That patent was alleged to provide a cable fairing for assembly with and in substantial alignment with a plurality of like cable fairings on a cable. The fairing included a flexible hollow nose for accomodating the cable and at least some comparatively rigid tall member, and means for joining the fairing to the next adjacent fairing of a plurality of assembled fairings.

Yet another such faired cable was provided in Canadian Pat. No. 919,998 issued Jan. 30, 1973 to P. B. Kennedy. That patent was said to provide a low-drag, high-speed towing cable for towing submerged objects. The towing cable had an elongated leading edge member and an elongated trailing edge member assembled continuously along a plane parallel to the towing cable elongate dimension to form an overall constant hydrofoil cross-sectional shape.

Still another such faired cable was provided by Canadian Pat. No. 966,015 issued Apr. 15, 1975 to D. Toussainst et al. That patent was said to provide a fairing or jacketing for underwater cables, with streamline profile. The profile was composed of two completely separable profiled strips for individual reeling, each having a first surface to be placed into abutment with the first surface of the respective other first strip and each having a second surface disposed symmetrically to a plane defined by the first surfaces when placed in abutment to each other. The strip each had at least one recess open to the first surface, the recesses having location and contour complementary to each other to define an elongated cavity for loosely receiving the rope or cable when the first surfaces are in mutual abutment. Fastening means were provided on the strips in the first surfaces thereof for releasably interconnecting the two strips between the cavity and the leading edge of the profile, and for releasably interconnecting the two strips between the cavity and the trailing edge of the profile.

Yet another fairing is provided by Canadian Pat. No. 1,018,834 issued Oct. 11, 1977 to J. A. R. Marchag et al.

Still another cable fairing was provided by Canadian Pat. No. 1,045,471 issued Jan. 2, 1979 to T. I. Silvez. This patent provided a hydrodynamic cable fairing section comprising a nose portion, a body portion having two side surfaces and vane means comprising a plurality of vanes connected to each side surface of said body portion. The plurality of vanes was substantially parallel to each other. The nose portion had a continuous curved surface and a longitudinal through bore means for receiving a cable. The body portion extended from the nose portion and tapered from the nose portion towards a trailing edge which forms part of the body portion. Each of the vanes included flat surfaces which tapered toward the trailing edge of the body portion.

Other patents which are of interest in this respect include U.S. Pat. Nos: 3,060,886, 3,092,067, 3,176,646, 3,194,204, 3,233,571, 3,352,274, 3,343,515, 3,343,516 and 3,379,161.

Drawbacks of the Prior Art

Nevertheless, the fairings and faired cables described above suffer from one or more drawbacks.

More sophisticated towed naval sonar systems use fairings which are reasonably effective. The problem is that these are permanent fairings, which remain with the cable, and are wound with it on and off the hoist drum used to store the cable. As multilayer winding of the faired cable on and off the drum is virtually impossible without fairing destruction, single layer winding is obligatory. For very long cables this necessitates the use of hoist drums of enormous size, often large enough to make a towed system impractical where space is at a premium, which is nearly always the case on ships. In addition, to keep the drum face to a minimum length, the grooving of the drum must be pitched as closely as possible, and this necessitates the use of fairings with parallel sides, which is not the most optimum shape of maximum drag reduction.

As noted above, a number of quickly attachable/-detachable fairings have been developed in the past to overcome the problems described above. These fairings are attached during payout and detached during haul in outboard of the hoist drum to achieve the economy of space afforded by multilayer winding. The problem with such fairings up to now is that the quick attach-/detach feature has resulted in liberties being taken with the basic fairing shape. In fact, some "snap on" fairings are of quite crude shape, and therefore are of very limited effectiveness. Hair and ribbon fairings have also been used to allow multilayer winding. They may be effective in reducing vibration, but are frequently worse than no fairings at all as regards to drag reduction. In short, the more effective the fairing, the more permanent the installation; and the greater the ease of applying and detaching the fairing, the less effective the fairing has been in reducing drag.

SUMMARY OF THE INVENTION

Aims of the Invention

Accordingly, objects of the present invention include the provision of fiarings which: have low drag; have low internal friction against stacking forces and cable reactions; have hydrodynamic stability; are of reasonably inexpensive to produce—one-piece construction; are reasonably light weight; have high resistance to distortion under hydro-dynamic forces; are accurately reproducible in high volume production; are quickly attachable and detachable, given proper tooling, storage magazine and automated feeding means; and will allow multilayer spooling of long lengths of bare cable on the hoist drum. While all of the prior art fairings have one or more of the above features, none of the prior art has all of them.

Statement of Invention

By this invention, a one-piece fairing is provided of the finite length monolithic one-piece, snap-on, foil-shaped, low drag fairing element of streamlined hydrodynamic shape, having an outer wall formed of high strength material, the fairing element being symmetrical about its central longitudinal axis, and adapted to be associated with a plurality of similar such fairing elements in end-to-end abutting relation on a cable, the fairing element comprising: a hollow rounded nose portion within which the cable is adapted to be disposed; a spring tail portion provided by a slit in the tail thereof along the central longitudinal axis; a hollow expandible channel symmetrical about the central longitudinal axis interconnecting the spring tail portion and the hollow nose portion, and through which the cable is adapted to be urged from its entry at the tail portion to its lodging at the hollow rounded nose portion; and an inner wall section of the high strength material spaced from the outer wall of the substantially hollow fairing element by a plurality of ribs of the high strength material, thereby defining the hollow expandible channel and also a double wall section along the flanks of the fairing element between the nose portion and the tail portion.

This invention also provides a combination, with a cable, of a plurality of substantially hollow, finite length monolithic one-piece, snap-on, foil-shaped, low drag fairing elements of streamlined hydrodynamic shape, having an outer wall formed of high strength material, each of the fairing elements being symmetrical about their central longitudinal axes, and adapted to be associated with a plurality of similar such fairing elements in end-to-end abutting relation in a cable, each of the fairing elements comprising: a hollow rounded nose portion within which the cable is adapted to the disposed; a spring tail portion provided by a slit in the tail thereof along the central longitudinal axis; a hollow expandible channel symmetrical about the central longitudinal axis interconnecting the spring tail portion and the hollow nose portion, and through which the cable is adapted to be urged from its entry at the tail portion to its lodging at the hollow rounded nose portion; and an inner wall section of the high strength material spaced from the outer wall of the substantially hollow fairing element by a plurality of ribs of the high strength material, thereby defining the hollow expandible channel and also a double wall section only along the flanks of the fairing element between portion and the tail portion.

Other Features of the Invention

By a preferred feature thereof, a pair of opposed ends of the fairing provide abutting surfaces on the mutually opposed adjacent elements when they are arranged end-to-end extending along a predetermined path, each such abutting surface including a recessed end non-contact extending from the tail and along the flank towards the now short contact surfaces at, and flanking each side of the cable; and an angularly bevelled non-contact surface at the nose to allow for cable curvature, thereby reducing movement by minimizing the moment arm to the point where friction forces act.

By another feature thereof, fairing element includes a pair of opposed internal engagement surfaces adjacent the hollow nose portion of the fairing element.

By another feature, the double walled flank section is defined by a plurality of separate chambers provided by a plurality of longitudinally extending ribs extending between the upper wall and the outer wall, the ribs being so disposed as to be parallel to the cable.

By yet another feature, the fairing includes a coating of a corrosion-resistant fluorocarbon polymer thereon.

By a feature of the combination, in the fairing, a pair of opposed ends of the fairing provide abutting surfaces on the mutually opposed adjacent elements when they are arranged end-to-end extending along a predetermined path, each such abutting surface including a recessed end non-contact surface extending from the tail and along the flank towards the nose; short contact surfaces at, and flanking, each side the cable; and an angularly bevelled non-contact surface at the nose to allow for cable curvature, thereby reducing friction movement by minimizing the moment arm to the point where friction forces act.

By another feature thereof, the combination includes a plurality of thrust rings disposed periodically around the cable in addition to the fairings.

By another variant, the such fairing includes a coating of a corrosion-resistant fluorocarbon polymer thereon.

BRIEF DESCRIPTION OF THE DRAWINGS

In the accompanying drawings.

DESCRIPTION OF PREFERRED EMBODIMENTS

Figure 1:
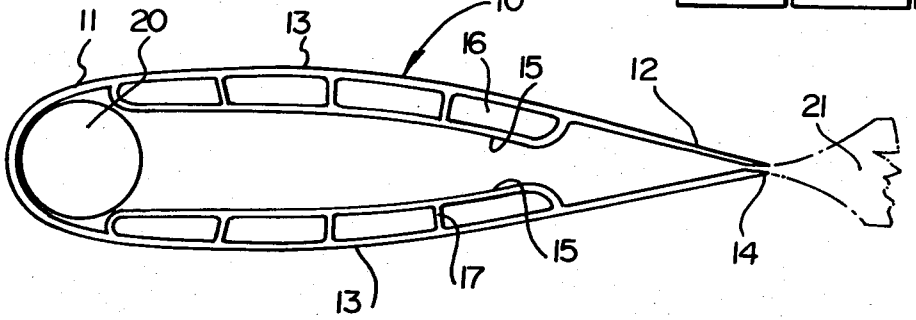
FIG. 1 is a section taken through a fairing of the present invention and a cable.

Description of Embodiment of FIG. 1

As seen in FIG. 1, the fairing 10 is designed using a basic high lift, low-drag wing foil shape with modified nose known as NACA 0025, although other symmetric foil shapes could also be adapted for use. (NACA is an abbreviation for the National Advisory Committee for Aeronautics). This shape is distinctly better hydrodynamically than the parallel side fairings used in permanent installations and can be used to advantage here because there is no necessity to store the fairings on the drum.

The fairing 10 includes a rounded nose portion 11, a tail section 12 and a pair of flanks 13. The fairing is sprung at the tail 12 by means of a longitudinal slit 14 therein. The purpose of slit 14 will be described hereinafter. The flanks 13 are provided as doubled walled members including an inner wall 15. Preferably the double walled members are provided as a plurality of longitudinally extending chambers 16 defined by a plurality of longitudinally extending ribs 17. The ribs 18 adjacent the nose 11 provide internal engagement surfaces to aid in retaining the cable 20 in place.

For light weight combined with stiffness, the preferred material of construction of the fairing is a high-strength aluminum alloy closed extrusion, wherefrom the individual fairings can be parted off in convenient lengths of say one foot each.

The tail 12 of the fairing 10 is slit open at 14 to allow insertion of installation tooling. One method involves the use of a spreader bar 21 as shown in chain dotted lines in FIG. 1. This spreader bar 21 would be used to pry apart the tail 12, one corner of the spread fairing 10 would be slipped over the cable 20, the spreader bar 21 then removed, and then the entire fairing 10 would be snapped over the cable 20 with further assistance from the spreader bar. No links interconnecting adjacent fairings are required. On detaching the fairings 10, the spreader bar 21 would again be inserted into the tail slit 14, the fairing 10 removed until the cable 20 hits the tip of the spreader bar 21, the spreader bar 21 then removed and the fairing 10 would then be snapped off the cable 20.

Figure 2:
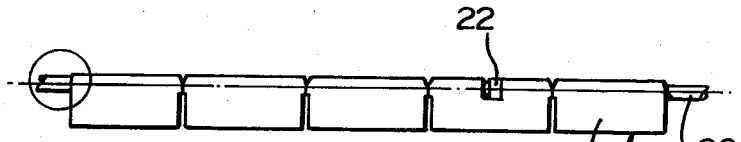
FIG. 2 is a longitudinal view of a cable and fairing system of this invention.
Figure 2A:
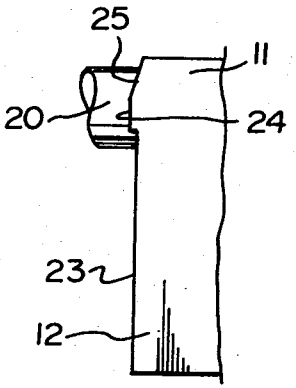
FIG. 2*a* is an enlargement of a portion of a cable and fairing system of this invention.

Description of Embodiment of FIG. 2

As seen in FIG. 2, the fairings 10 are disposed on the cable 20. If the cable is inclined to the flow, a portion of the drag acts to push the fairing down the cable. When allowed to accumulate over an entire cable length, this "stacking" force can reach truly large proportions, and has been known to damage or destroy fairings at the lower reaches or distal end of the cable. It is now becoming commonplace to relieve these stacking forces by installing thrust rings, seen as rings 22 in FIG. 2, (called "anti-stacking rings") periodically around the cable 20. In this manner, stacking forces can only build up over a section of fairings 20 between two adjacent rings 22, and will not be transmitted to the next section of fairings 20. Nevertheless, even small stacking forces may be large enough through the action of friction between adjacent fairings, when coupled with friction between the cable and fairing nowe, to create friction moments which will prevent lifting forces from straightening out a misaligned fairing. A misaligned fairing acts as a rudder to produce cable tow-off. This effect can be alleviated by two means. The first is to cut the fairing ends as shown in FIG. 2. As seen in FIG. 2, the fairings 10 have their ends cut as follows. A shallow recess 23 is cut into the ends of the fairings aft of cable 20 to prevent contact in that zone with adjacent fairings. Short contact surfaces 24 are provided on the fairing ends at and flanking each side of the cable. At the forward portion of the nose 11, a bevelled section 25 is provided to allow cable flexure. This structure will reduce the friction moment by minimizing the moment art to the point where frictions forces act.

The second means is to coat the entire fairing 10 with a corrosion-resistant, baked-on, dry-lubricant fluorocarbon coating (not shown). This will reduce the friction moment by reducing the coefficient of friction and thus the friction force. It will also increase the corrosion of the fairing, and is a preferred embodiment of this invention.

Figure 3:
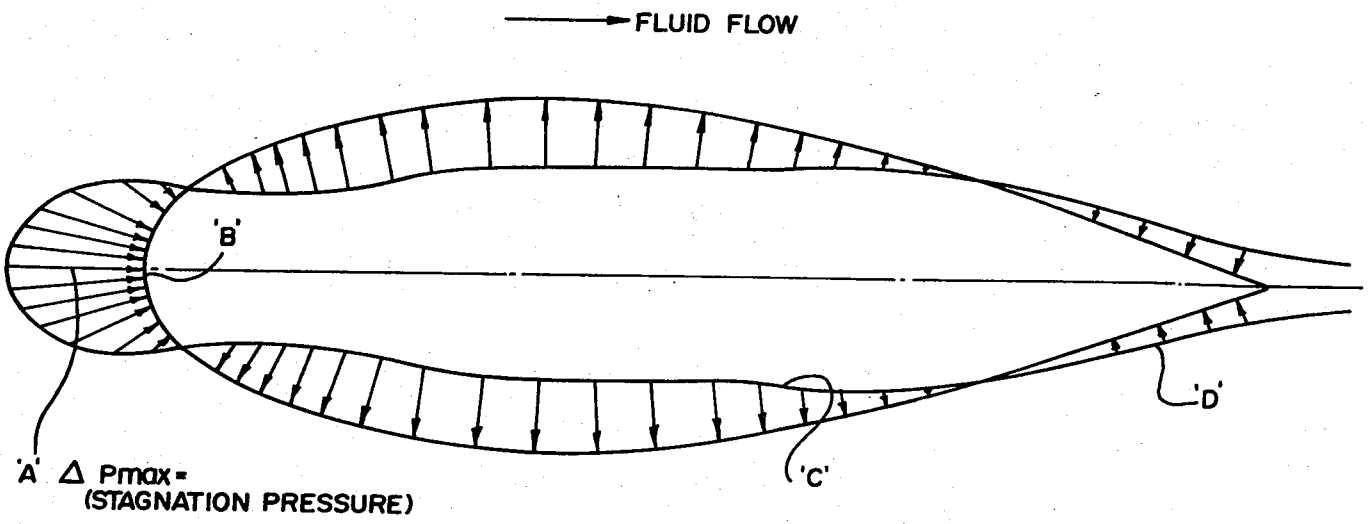
FIG. 3 is a schematic view of the development of hydrodynamic pressure as fluid flows past a streamlined shape.

Description of FIG. 3

In a preferred variant of the fairing of an aspect of this invention, most of the flanks 13 of the fairings 10 are reinforced with a double wall 15. The reason for this can be deduced from FIG. 3, which is taken from the results of model tests done by the National Research Council of Canada on domes of similar shape many years ago. When a fluid flows past a streamlined shape (or conversely, when such a shape moves in a stationary fluid), a concentrated zone of high pressure A builds up at the nose "B". This "stagnation pressure" is inward, and is equal to $\frac{1}{2}$ $pV^2$, where p=mass density of the fluid and V is speed. In the case of a fairing, this pressure is resisted by cable reaction from cable A. This is followed by a negative pressure "C" on the forward flanks tending to force them apart and a much smaller positive pressure "D" on the trailing section. The net result on a fairing split at the tail would be that the flanks would be deflected outward as a cantilever beam "built in" at the nose. In an unreinforced split fairing, this deflection may easily be so large at high speeds as to distort the basic fairing shape so badly that its primary function as a drag reducer is destroyed. The use of double walls 15 thus serves to introduce reinforcement to the flanks to limit hydrodynamic outward deflection to only thousandths of an inch.

SUMMARY

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

I claim:

1. A finite length monolithic one-piece, snap-on, foil-shaped low drag fairing element of streamlined hydrodynamic shape, having an outer wall formed of high strength material, the fairing being symmetrical about its central longitudinal axis, and adapted to be associated with a plurality of similar such fairing elements in end-to-end abutting relation on a cable, said fairing element comprising: a hollow rounded nose portion within which said cable is adapted to be disposed; a spring tail portion provided by a slit in the tail thereof along the central longitudinal axis; a hollow expandible channel symmetrical about said central longitudinal axis interconnecting said spring tail portion and said hollow nose portion, and through which said cable is adapted to be urged from its entry at said tail portion to its lodging at said hollow rounded nose portion; and an inner wall section of said high strength material spaced from said outer wall of said substantially hollow fairing element by a plurality of ribs of said high strength material, thereby defining said hollow expandible channel and also a double wall section along the flanks of said fairing element between said nose portion and said tail portion.

2. The substantially hollow monolithic fairing element of claim 1 wherein a pair of opposed ends of said fairing provide abutting surfaces on the mutually opposed adjacent elements when they are arranged end-to-end extending along a predetermined path, each said abutting surface including a recessed and non-contact surface extending from said tail and said flank towards said nose; short contact surfaces at, and flanking, each side of said cable; and an angularly bevelled non-contact surface at said nose to allow for cable curvature, thereby reducing friction momentby minimizing the moment arm to the point where friction forces act.

3. The substantially hollow monolithic fairing element of claim 1 including a pair of opposed internal engagement surfaces adjacent said hollow nose portion of said fairing element.

4. The substantially hollow monolithic fairing element of claim 1 wherein said double walled flank section is defined by a plurality of separate chambers provided by a plurality of longitudinally extending ribs extending between said upper wall and said outerwall, said ribs being so disposed as to be parallel to said cable.

5. The substantially hollow monolithic element of claim 1 including a coating of a corrosion-resistant, fluorocarbon polymer thereon.

6. In combination with a cable, a plurality of substantially hollow, finite length monolithic one-piece, snap-on, foil-shaped, low drag fairing elements of streamlined hydrodynamic shape, having an outer wall formed of high strength material, the fairing element being symmetrical about its central longitudinal axis, and adapted to be associated with a plurality of similar such fairing elements in end-to-end abutting relation in a cable, each of said fairing elements comprising: a hollow rounded nose portion within which said cable is adapted to be disposed; a spring tail portion provided by a slit in said tail thereof along said central longitudinal axis; a hollow expandible channel symmetrical about said central longitudinal axis interconnecting said spring tail portion and said hollow nose portion, and through which said cable is adapted to be urged from its entry at said tail portion to its lodging at said hollow rounded nose portion; and an inner wall section of said high strength material spaced from said outer wall of said substantially hollow fairing element by a plurality of ribs of said high strength material, thereby defining said hollow expandible channel and also a double wall section only along said flanks of said fairing element between said portion and said tail portion.

7. The combination of claim 6 including a plurality of thrust rings disposed periodically around said cable in addition to said fairings.

8. The combination of claim 6 wherein a pair of opposed ends of said substantially hollow monolithic fairing element provide abutting surfaces said mutually opposed adjacent elements when they are arranged end-to-end extending along a predetermined path, each said abutting surface including a recessed end, non-contact surface, extending from said tail and along said flank towards said cable; and an angularly bevelled, non-contact, surface at said nose to allow for cable curvature, thereby reducing friction moment by minimizing the moment arm to the point where friction forces act.

9. The combination of claim 6 including a coating of a corrosion-resistant fluorocarbon polymer on each said fairing element.

* * * * *